US005181172A

United States Patent [19]

Whitten

[11] Patent Number: 5,181,172

[45] Date of Patent: Jan. 19, 1993

[54] METHOD FOR PREDICTING DRILLSTRING STICKING

[75] Inventor: Ronald G. Whitten, Berlin, Conn.

[73] Assignee: Teleco Oilfield Services Inc., Meriden, Conn.

[21] Appl. No.: 436,237

[22] Filed: Nov. 14, 1989

[51] Int. Cl.[5] ..... G06F 15/20; E21B 44/00

[52] U.S. Cl. ..... 364/422; 73/151

[58] Field of Search ..... 73/151; 364/422; 175/24, 27

[56] References Cited

U.S. PATENT DOCUMENTS

| | | | |
|---|---|---|---|
| 4,382,381 | 5/1983 | Soeiinah | 73/151 |
| 4,384,483 | 5/1983 | Dellinger et al. | 73/151 |
| 4,695,957 | 9/1987 | Peltier | 364/422 |
| 4,739,841 | 4/1988 | Das | 175/61 |
| 4,760,735 | 8/1988 | Sheppard et al. | 73/151 |
| 4,791,998 | 12/1988 | Hempkins et al. | 175/61 |

OTHER PUBLICATIONS

Hollander et al., "The Drilling Advisor", *IEEE* 1983 *Proceeding of Trends and Applications.*

C. A. Johancsik, D. B. Friesen, R. Dawson, "Torque and Drag in Directional Wells-Prediction and Measurement", *Journal of Petroleum Technology,* Jun. 1984—directed to a computer model for predicting torque and drag on a drillstring.

R. Whitten, "Application of Side-Force Analysis and MWD to Reduce Drilling Costs", SPE/IADC 1987 Drilling Conference, Mar. 1987.

*Primary Examiner*—Roy N. Envall, Jr.
*Assistant Examiner*—David Huntley
*Attorney, Agent, or Firm*—Fishman, Dionne & Cantor

[57] ABSTRACT

A method for predicting drillstring sticking while drilling a borehole includes evaluating the borehole severity for the drillstring at two or more measured bit depths, evaluating the rate of change of borehole severity with bit depth, and predicting the onset of drillstring sticking based on the magnitude of the rate of change of borehole severity with bit depth.

16 Claims, 6 Drawing Sheets

METHOD FOR PREDICTING DRILLSTRING STICKING

TECHNICAL FIELD

This invention relates to the field of sensing of borehole parameters, particularly parameters of interest in the drilling of oil well boreholes.

BACKGROUND

In the directional drilling of oilwell boreholes, it is not uncommon for the drillstring to become mechanically stuck within the borehole. The recovery and replacement costs associated with a stuck drillstring are high. Accordingly, there is an interest in the art in developing methods for predicting the onset of drillstring sticking so that action may be taken to avoid the problem. Johancsik et al developed an interactive technique for the determination of torque and drag on a drillstring based upon the interaction between the borehole and the drillstring; "Journal of Petroleum Technology", June 1984, P987. In R.G. Whitten, "Application of Side Force Analysis and MWD to Reduce Drilling Costs", 1987 SPE/IADC Drilling Conference, a method for concentration of torque and drag effects in the bottom hole assembly (BHA) was suggested, and the concept of borehole severity as a single value measurement of the interaction between BHA and the borehole was introduced. This work suggested that mechanical sticking of the drillstring may be predicted based on the borehole severity profile and interpreted lithology taken from measured while drilling (MWD) gamma ray measurements and identified the direction of the borehole severity slope and the location of stabilizers relative to standing formations (determined from the gamma ray readings) as critical factors in determining the onset of drillstring sticking.

DISCLOSURE OF THE INVENTION

A method for predicting onset of drillstring sticking while drilling a borehole is disclosed. A first borehole severity value, $BHS_1$, is calculated for the drillstring at a first measured bit depth, $D_1$. A second borehole severity value, $BHS_2$, is calculated for the drillstring at a second measured bit depth, $D_2$. A first borehole severity slope value, $BHSS_1$, is calculated to quantify the difference in borehole severity relative to the difference between bit depth $D_1$ and bit depth $D_2$, where:

$$BHSS_1 = \frac{BHS_2 - BHS_1}{D_2 - D_1}$$

The first borehole severity slope value is compared to a reference borehole severity slope value. The onset of drillstring sticking is predicted based on the magnitude of the difference between first borehole severity slope value and the reference borehole severity slope value.

BRIEF DESCRIPTION OF THE DRAWINGS

FIG. 2, which includes

DESCRIPTION OF THE PREFERRED EMBODIMENT

A drillstring is used to drill an oil well borehole through a geological formation. The drillstring extends from a drilling platform on the surface of the formation to a bit at the bottom of the borehole and comprises a plurality of elements, including drillpipe elements and a bottom hole assembly (BHA). The drillpipe elements extend from the drilling platform to the top of the BHA. The BHA extends from the bottom drillpipe element to the bit. The BHA includes the bit, reamers, and stabilizers of the drillstring.

Figure 1:
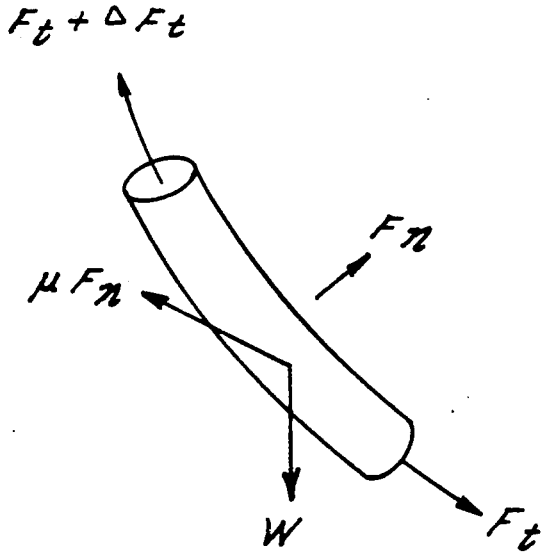
FIG. 1 shows a force balance on a bottom hole assembly element.

FIG. 1 shows a force balance on a bottom hole assembly element illustrating the sources of normal force. The force on each element may be calculated using the equations for slacking off the drillstring:

$$Fn = ((Ft_b \Delta\alpha \sin\bar{\theta})^2 + (Ft_b \Delta\bar{\theta} + W\sin\theta^2)^{\frac{1}{2}} \quad (1)$$

$$\Delta Ft = W\cos\bar{\theta} - \mu Fn, \quad (2)$$

$$Ft_t = Ft_b + \Delta Ft \quad (3)$$

where:

Fn = normal force on element (1*bf*),
$Ft_b$ = tensile force on bottom of element (1*bf*),
$Ft_t$ = tensile force on top of element (1*bf*),
$\Delta\alpha$ = azimuth change over element (radians),
$\bar{\theta}$ = mean inclination of element (radians),
$\Delta\theta$ = inclination change over element (radians),
W = air weight of element (1*b*),
$\Delta Ft$ = incremental tension (1*bf*), and
$\mu$ = friction factor.

The initial tension value is set equal to the upward pressure exerted by the hydrostatic column of fluid in the wellbore acting on the cross sectional area of the drillstring at the vertical depth of the bit increased by the weight on the bit When proceding sequentially upwardly from the bottom of the BHA, the tensile force on the bottom of the element $Ft_b$, is equal to the tensile force on the top of the previous element, assuming that the geometry of the element is the same.

The hydrostatic effect on the drillstring will change each time the geometry of the element cross-sectional area changes. The proper treatment of these changes requires that the true vertical depth at these changes is known. The hydrostatic pressure is calculated for that depth and the forces acting on the two cross sectional areas are calculated. To calculate the effective tensile force acting on the bottom of the upper element, the following manipulation is performed:

$$Ft_{bH} = Ft_{tl} - H\pi/4\,(OD_1^2 - OD_2^2 - ID_1^2 + ID_2^2), \quad (4)$$

where:

$Ft_{bH}$ = tensile force on bottom of element, corrected for hydrostatic forces,
$Ft_{tl}$ = tensile force on top of previous element,
H = hydrostatic pressure,
$OD_1$ = outer diameter of previous element,
$OD_2$ = outer diameter of element,
$ID_1$ = inner diameter of previous element, and
$ID_2$ = inner diameter of element.

$Ft_{bH}$ may then be substituted for $Ft_b$ in equation 3 above in order to calculate the forces on the element.

The cumulative normal force on the bottom hole assembly may be calculated by iteratively calculating the normal force on each element of the bottom hole assembly and summing the normal force values so calculated from the bit to the top of the bottom hole assembly.

The borehole severity (BHS) for the BHA at the bit depth is calculated by dividing the accumulated value of Fn for the BHA by the length of the BHA according to equation 5:

$$BHS = \frac{\text{Sum of normal forces on } BHA}{\text{Length of } BHA} \quad (5)$$

As each survey is made, the borehole severity is recalculated for the current measured bit depth.

The borehole severity slope is calculated by dividing the change in BHS by the difference in measured depth, according to equation 6:

$$BHSS = \frac{\Delta BHS}{\Delta D} \quad (6)$$

The value of borehole severity slope is plotted vs measured bit depth. A sudden change in the value of the borehole severity slope with increasing depth is strongly indicative of the onset of drillstring sticking.

FIG. 2 is a flowchart outlining the process steps of the method of the present invention. value. Starting from the top of FIG. 2A, drillstring data from file 4, historical data from file 8, casing data from file 12 and mud data from file 16 are input (functional blocks 6, 10, 14, and 18) to initialize the system. Drillstring data includes the length, inner diameter, outer diameter and specific weight of each drillstring element. Historical data includes previously measured values for depth, inclination and azimuth of the wellbore as well as calculated values for the true vertical bit depth at each measurement depth. Casing data includes measured depth at the bottom of each casing string and the inner diameter of the innermost string Mud data includes mud weight.

The hydrostatic force acting on the bit is calculated (functional block 20).

Figure 2A:
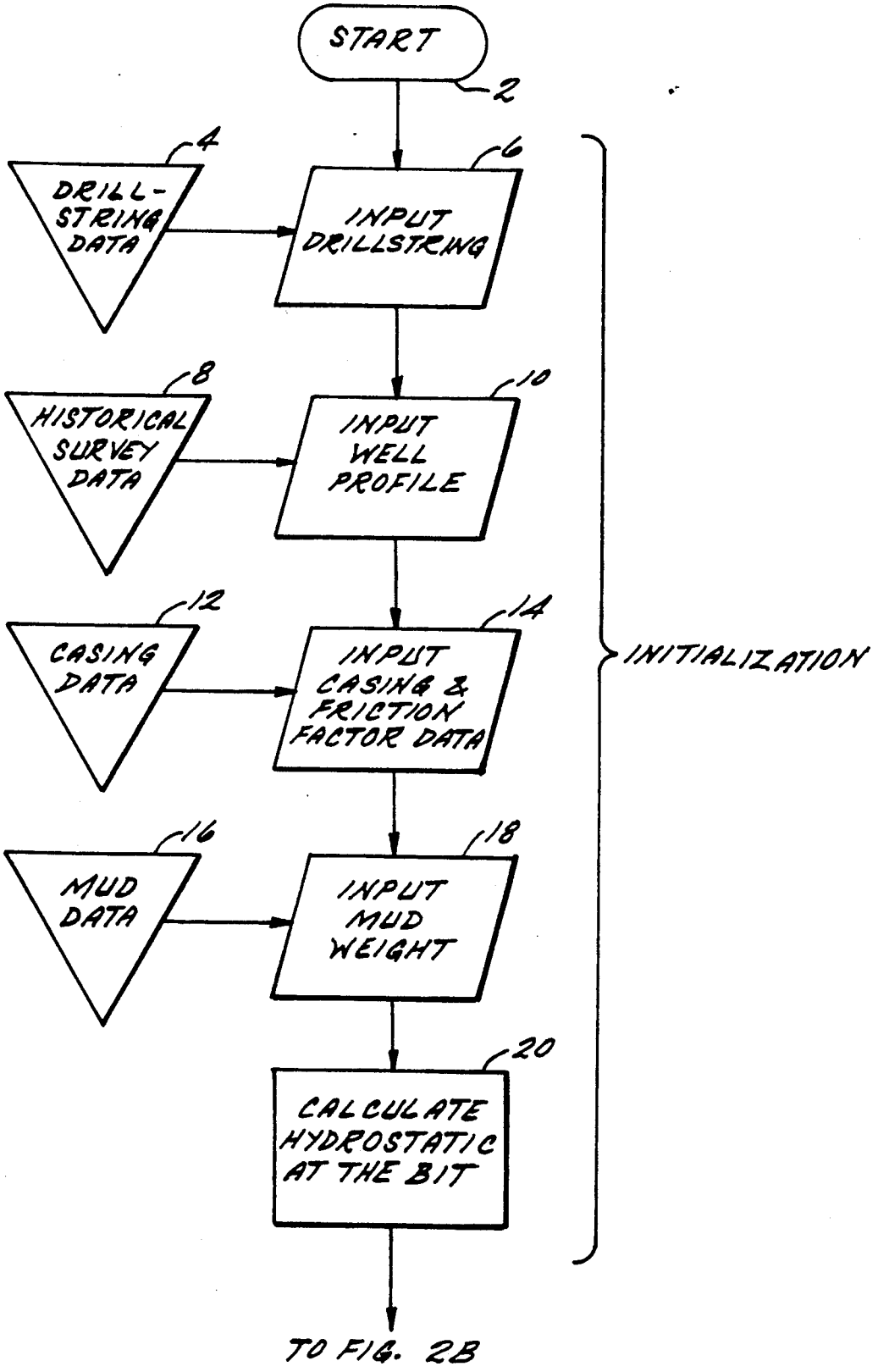
FIGS. 2A–2D, shows a flow chart outlining the method of the present invention.
Figure 2B:
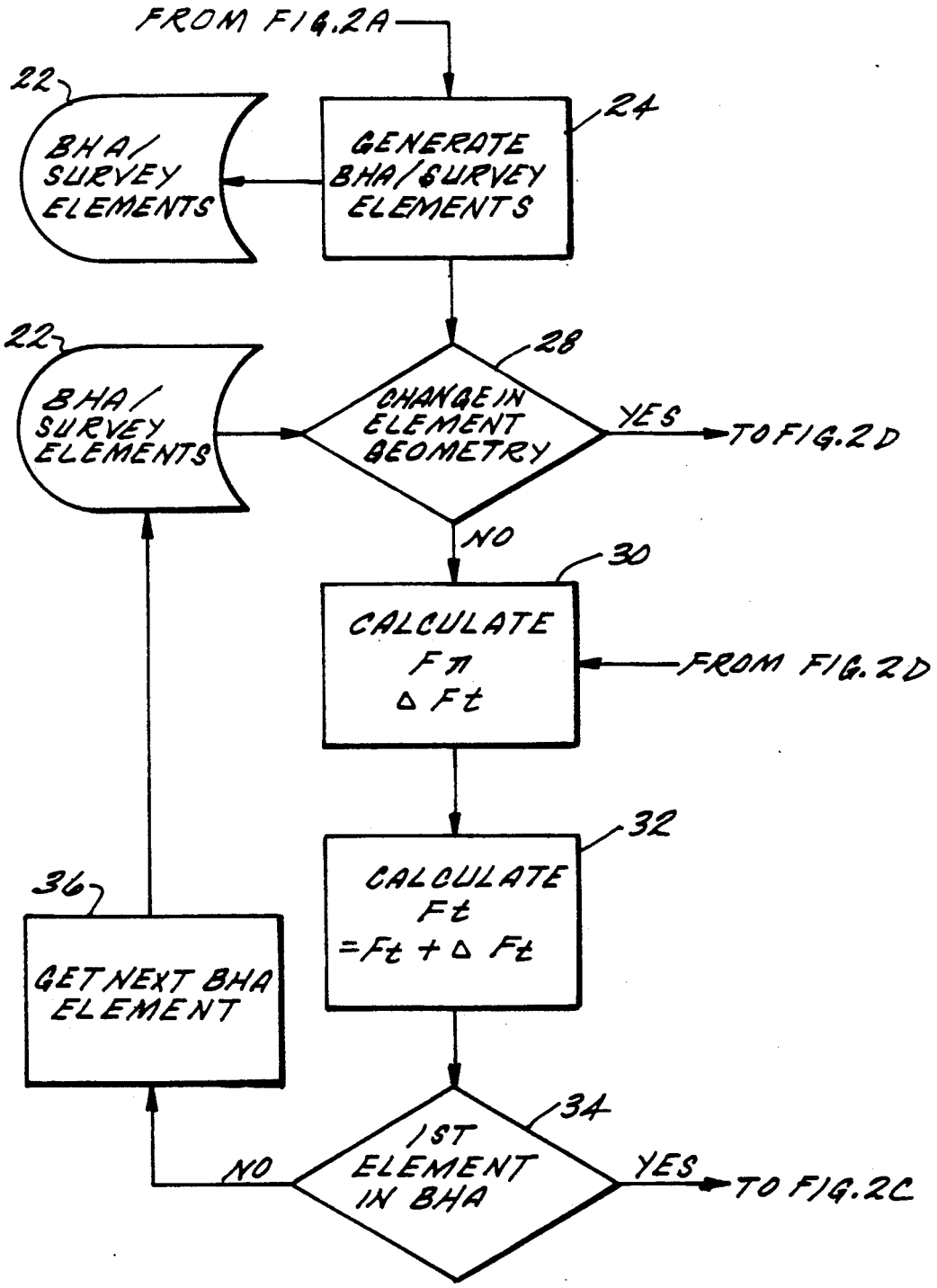

Continuing from the top of FIG. 2B, the bottom hole assembly is divided into a plurality of computational elements (functional block 24). Data defining the elements is filed in the element file 22. The initial tension is set equal to the hydrostatic pressure on the bit increased by the weight on the bit. The system flow passes from functional block 24 to the "change in geometry" test (functional block 28).

Figure 2C:
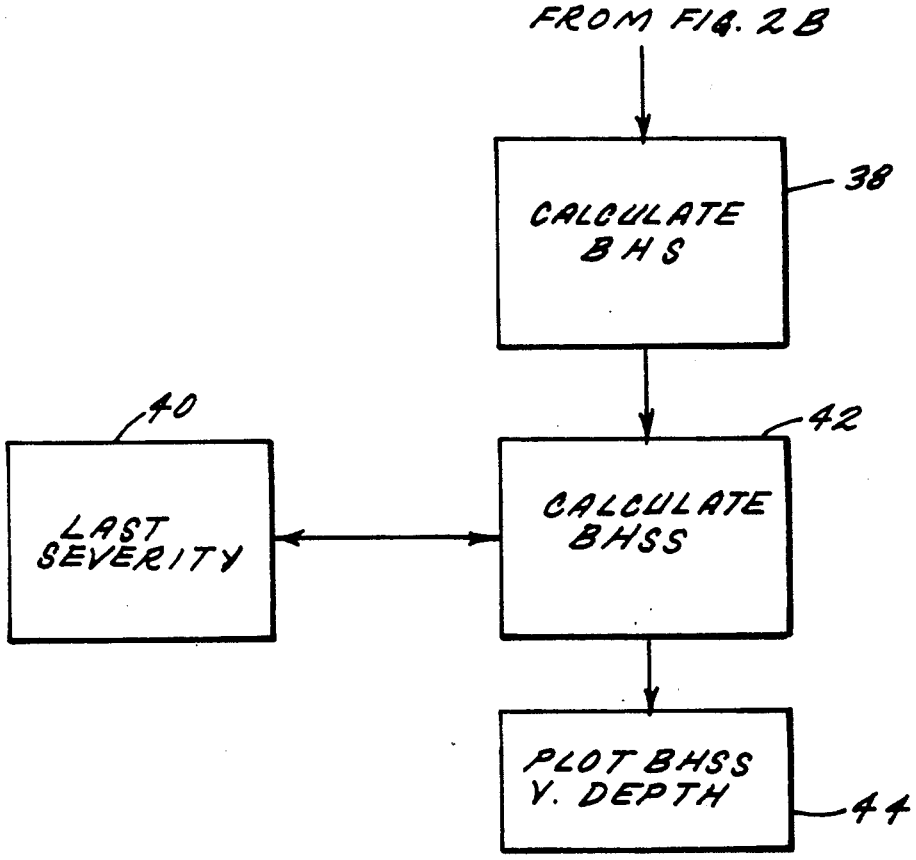
Figure 2D:
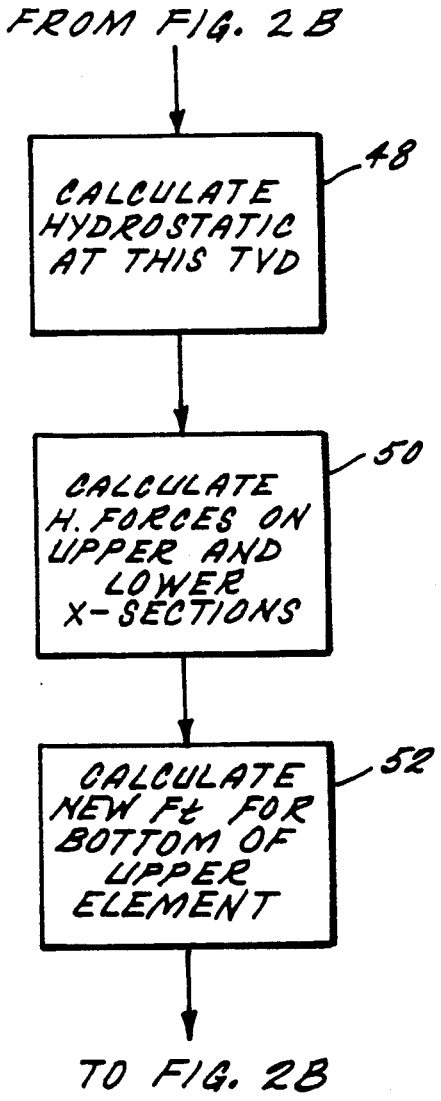

If the geometry of the element is different from the geometry of the previous element, the system flow passes to FIG. 2D.

Starting from the top of FIG. 2D, the hydrostatic pressure at the depth of the bottom of the element is calculated (functional block 48). The hydrostatic forces at the cross sections of the element and the previous element are calculated according to equation 4 above (functional block 50). The effective force on the bottom of the element is recalculated (functional block 52), according to equation 4 above. The system flow then returns to FIG. 2B at functional block 24.

If the element is the first element, if the geometry of the element is the same as the previous element, or if the tensile force on the bottom of the element has been recalculated according to the steps outlined in FIG. 2D, the system flow passes to the calculation of the normal force on the element and the change in tensile force over the element (functional block 30) and on to the calculation of the tensile force on the top of the element (functional block 32) according to equations 1, 2 and 3 above.

As the calculation of the forces on the element is completed, a "last element" test is conducted (functional block 34).

If the element is not the last element of the drillstring, the data defining the next element is retrieved (functional blocks 36) from file 22 and the loop is reentered at functional block 28 for calculation of the forces on the next element.

If the element is the last element of the BHA, the system flow passes from the "last element" test of functional block 28 to the borehole severity calculation (functional block 38) at the top of FIG. 2C. The current borehole severity (BHS) value is calculated according to equation 5 above. The previous borehole severity value is retrieved from file 40. The current borehole severity value and the previous borehole severity value are used to calculate a value for the borehole severity slope (BHSS) (functional block 42) according to equation 6 above. The current borehole severity value is stored in file 40. The BHSS is plotted versus depth (functional block 44).

Upon the input of new survey data, the plot may be updated by reentering FIG. 2B at functional block 20.

The borehole severity slope values are monitored during drilling. A sudden change in borehole severity slope with increasing depth is strongly indicative of the onset of drillstring sticking. Monitoring the borehole severity value during drilling allows corrective action to be taken prior to the drillstring becoming mechanically stuck in the borehole.

EXAMPLE

Drillstring data for a drillstring which became mechanically stuck in the borehole was used with well data in a post drilling analysis to determine if the borehole severity plot could have been used to detect the onset of drillstring sticking. The drillstring had become stuck at a measured depth of (X+238) ft.

Figure 3:
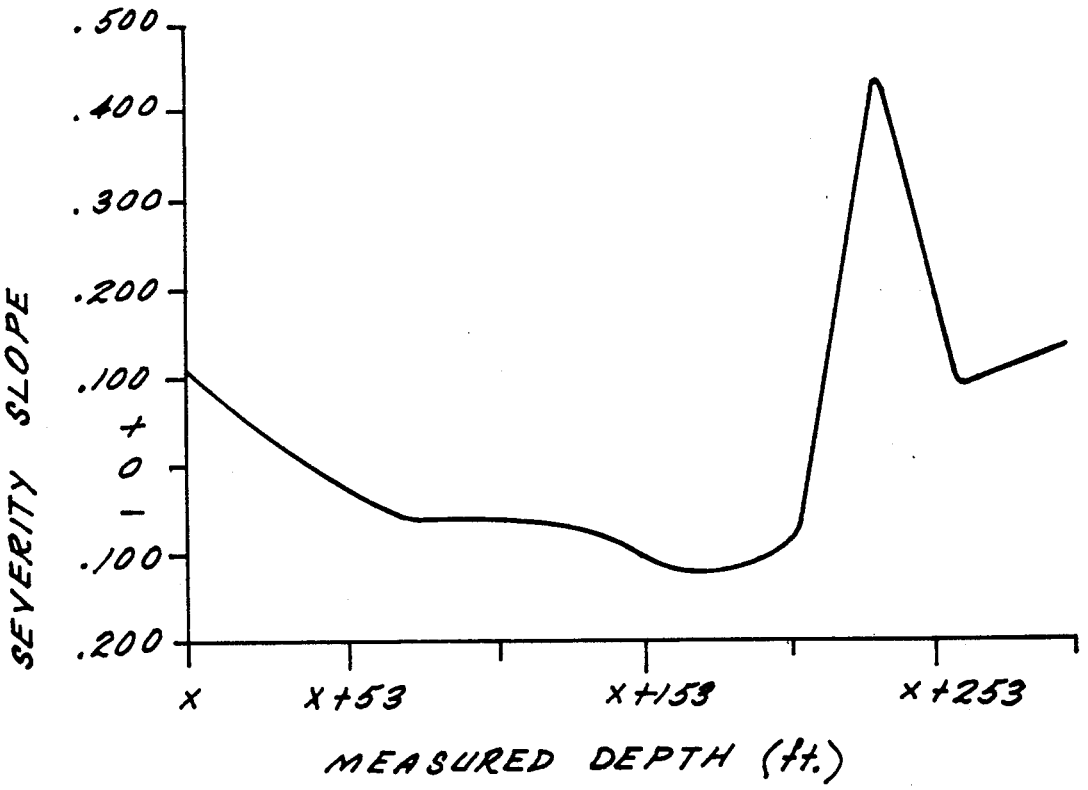
FIG. 3 shows a plot of borehole severity vs bit depth.

Borehole severity values were calculated according to the method of the present invention a series of the survey points. From these values, and the differences in measured depth distance between the values, the slope of the borehole severity curve was calculated according to the method of the present invention for each survey point. The values are given in Table 3. A plot of borehole severity v. measured depth is given in FIG. 3.

TABLE 3

| Measured Depth (ft) | Borehole Severity | Borehole Severity Slope |
|---|---|---|
| X | 116 | +.105 |
| X +83 | 111 | −.060 |
| X +113 | 109 | −.067 |
| X +145 | 106 | −.094 |
| X +176 | 102 | −.129 |
| X +207 | 99 | −.097 |
| X +238 | 112 | +.419 |
| X +269 | 115 | +.097 |
| X +299 | 119 | +.133 |

The slope of the borehole severity curve fluctuates between approximately +0.1 and −0.1 and abruptly jumps to +0.419 at (X +238) ft, just prior to the drillstring becoming stuck.

Between (X+207) and (X+238), the borehole severity slope increased instantly to almost four times its means previous value for the well. As can be seen from the plot of slope versus depth in FIG. 3, the slope increases at the onset of drillstring sticking is both dramatic and clearly observable.

The borehole severity plot of the present invention is much more comprehensive than a conventional dogleg severity plot since, by taking into consideration the weight of the various string elements and their interaction with the borehole, the borehole severity plot gives importance to the part of the string in the dogleg. This interactive element changes the importance assigned to any particular borehole angular change and provides a measure of the degree of danger involved in each particular dogleg.

The borehole severity plot has been used with well data in a post well analysis mode to determine if the plot could have been used to detect the problem which led to sticking of the reaming assembly. The analysis of the stuck drillstring demonstrates that by monitoring the borehole severity slope, in the absence of gamma ray data, it would have been possible to detect the onset of drillstring sticking and to attempt remedial action prior to the drillstring becoming stuck.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for predicting onset of drillstring sticking while drilling a borehole, comprising:

(1) drilling a borehole from a first measured bit depth $D_1$ to a second measured bit depth $D_2$;

(2) calculating a first borehole severity value, $BHS_1$ for the drillstring at the first measured bit depth $D_1$;

(3) calculating a second borehole severity value, $BHS_2$ for the drillstring at the second measured bit depth, $D_2$;

(4) calculating a first borehole severity slope value, $BHSS_1$ for the difference in borehole severity relative to the difference in measured bit depth between $D_1$ and $D_2$, where:

$$BHSS_1 = \frac{BHS_2 - BHS_1}{D_2 - D_1};$$

(5) comparing $BHSS_1$ to a reference borehole severity slope value, $BHSS_0$;

(6) predicting onset of drillstring sticking based on the magnitude of the difference between $BHSS_1$ and $BHSS_0$; and (7) taking remedial action to avoid sticking of the drillstring in the borehole, if the drillstring sticking is predicted from step (6).

2. The method of claim 1, wherein the drillstring comprises a drillpipe and a bottom hole assembly, the bottom hole assembly has a length and comprises a plurality of elements, normal forces are exerted on the elements of the bottom hole assembly and each borehole severity value is calculated by the steps of:

dividing the bottom hole assembly into a plurality of computational elements;

calculating the normal force on each element;

calculating a cumulative normal force for the bottom hole assembly by summing the normal forces for each element of the bottom hole assembly; and dividing the cumulative normal force by the length of the bottom hole assembly to obtain the borehole severity value.

3. The method of claim 2, wherein each element has a cross sectional area, the step of calculating the normal force on each element further comprises calculating the tensile force on each element and calculating the hydrostatic force on each element having a cross sectional area that is different from the cross sectional area of the preceding element.

4. The process of claim 1, wherein step (6) further comprises:

taking the remedial action to avoid sticking of the drillstring in the borehole, if it is predicted that the onset of drillstring sticking is imminent.

5. A method for predicting onset of drillstring sticking while drilling a borehole, comprising:

(1) drilling a borehole from a first measured bit depth $D_1$ to a second measured bit depth $D_2$;

(2) calculating a first borehole severity value, $BHS_1$ for the drillstring at the first measured bit depth $D_1$;

(3) calculating a second borehole severity value, $BHS_2$ for the drillstring at the second measured bit depth, $D_2$;

(4) calculating a first borehole severity slope value, $BHSS_1$ for the difference in borehole severity relative to the difference in measured bit depth between $D_1$ and $D_2$, where:

$$BHSS_1 = \frac{BHS_2 - BHS_1}{D_2 - D_1};$$

(5) drilling the borehole from $D_2$ to a third measured bit depth $D_3$;

(6) calculating a third borehole severity value, $BHS_3$, for the drillstring at the third measured bit depth, $D_3$;

(7) calculating a second borehole severity slope value, $BHSS_2$, for the difference in borehole severity relative to the difference in measured bit depth between $D_2$ and $D_3$, where;

$$BHSS_2 = \frac{BHS_3 - BHS_2}{D_3 - D_2};$$

(8) predicting onset of drillstring sticking based on the magnitude of the difference between $BHSS_2$ and $BHSS_1$; and (9taking remedial action to avoid sticking of the drillstring in the borehole, if drillstring sticking is predicted from step (8).

6. The process of claim 5, wherein step (8) further comprises:

taking the remedial action to avoid sticking of the drillstring in the borehole, if it is predicted that the onset of drillstring sticking is imminent.

7. The method of claim 4, wherein the drillstring comprises a drillpipe and a bottom hole assembly. The bottom hole assembly has a length and comprises a plurality of elements, normal forces are exerted on the elements of the bottom hole assembly and each borehole severity value is calculated by the steps of:

dividing the bottom hole assembly into a plurality of computational elements;

calculating the tensile force on each element and the normal force on each element;

calculating a cumulative normal force for the bottom hole assembly by summing the normal forces for each element of the bottom hole assembly; and dividing the cumulative normal force by the length of the bottom hole assembly.

8. The method of claim 5, wherein each element has a cross sectional area, and the step of calculating the normal force on each element further comprises calculating the tensile force on each element and calculating the hydrostatic force on each element having a cross sectional area that is different from the cross sectional area of the preceding element.

9. A method for predicting onset of drillstring sticking while drilling a borehole, consisting essentially of:

(1) drilling a borehole from a first measured bit depth $D_1$ to a second measured bit depth $D_2$;

(2) calculating a first borehole severity, $BHS_1$ for the drillstring at the first measured bit depth $D_1$;

(3) calculating a second borehole severity value, $BHS_2$ for the drillstring at the second measured bit depth, $D_2$;

(4) calculating a first borehole severity slope value, $BHSS_1$ for the difference in borehole severity relative to the difference in measured bit depth between $D_1$ and $D_2$, where:

$$BHSS_1 = \frac{BHS_2 - BHS_1}{D_2 - D_1};$$

(5) comparing $BHSS_1$ to a reference borehole severity slope value, $BHSS_0$;

(6) predicting onset of drillstring sticking based on the magnitude of the difference between $BHSS_1$ and $BHSS_0$; and (7) taking remedial action to avoid sticking of the drillstring in the borehole, if drillstring sticking is predicted from step (6).

10. The process of claim 9, wherein step (6) further comprises:

taking the remedial action to avoid sticking of the drillstring in the borehole, if it is predicted that the onset of drillstring sticking is imminent.

11. The method of claim 9, wherein the drillstring comprises a drillpipe and a bottom hole assembly, the bottom hole assembly has a length and comprises a plurality of elements, normal forces are exerted on the elements of the bottom hole assembly and each borehole severity value is calculated by the steps of:

dividing the bottom hole assembly into a plurality of computational elements;

calculating the normal force on each element;

calculating a cumulative normal force for the bottom hole assembly by summing the normal forces for each element of the bottom hole assembly; and dividing the cumulative normal force by the length of the bottom hole assembly to obtain the borehole severity value.

12. The method of claim 11, wherein each element has a cross sectional area, the step of calculating the normal force on each element further comprises calculating the tensile force on each element and calculating the hydrostatic force on each element having a cross sectional area that is different from the cross sectional area of the preceding element.

13. A method for predicting onset of drillstring sticking while drilling a borehole, consisting essentially of:

(1) drilling a borehole from a first measured bit depth $D_1$ to a second measured bit depth $D_2$;

(2) calculating a first borehole severity value, $BHS_1$ for the drillstring at a first measured bit depth $D_1$;

(3) calculating a second borehole severity value, $BHS_2$ for the drillstring at a second measured bit depth, $D_2$;

(4) calculating a first borehole severity slope value, $BHSS_1$ for the difference in borehole severity relative to the difference in measured bit depth between $D_1$ and $D_2$, where:

$$BHSS_1 = \frac{BHS_2 - BHS_1}{D_2 - D_1};$$

(5) drilling the borehole $D_2$ to a third measured bit depth $D_3$;

(6calculating a third borehole severity value, $BHS_3$, for the drillstring at a third measured bit depth, $D_3$;

(7calculating a second borehole severity slope value, $BHSS_2$, for the difference in borehole severity relative to the difference in measured bit depth between $D_2$ and $D_3$, where;

$$BHSS_2 = \frac{BHS_3 - BHS_2}{D_3 - D_2}; \text{ and}$$

(8predicting onset of drillstring sticking based on the magnitude of the difference between $BHSS_2$ and $BHSS_1$; and (9taking remedial action to avoid sticking of the drillstring in the borehole, if the drillstring sticking is predicted from step (8).

14. The process of claim 13, wherein step (8) further comprises: 'taking the remedial action to avoid sticking of the drillstring in the borehole, if it is predicted that the onset of drillstring sticking is imminent.

15. The method of claim 13, wherein the drillstring comprises a drillpipe and a bottom hole assembly. The bottom hole assembly has a length and comprises a plurality of elements, normal forces are exerted on the elements of the bottom hole assembly and each borehole severity value is calculated by the steps of:

dividing the bottom hole assembly into a plurality of computational elements;

calculating the tensile force on each element and the normal force on each element;

calculating a cumulative normal force for the bottom hole assembly by summing the normal forces for each element of the bottom hole assembly; and dividing the cumulative normal force by the length of the bottom hole assembly.

16. The method of claim 15, wherein each element has a cross sectional area, and the step of calculating the normal force on each element further comprises calculating the tensile force on each element and calculating the hydrostatic force on each element having a cross sectional area that is different from the cross sectional are of the preceding element.

* * * * *